US005867855A

United States Patent [19]

Kim

[11] Patent Number: 5,867,855

[45] Date of Patent: Feb. 9, 1999

[54] METHOD FOR CONNECTING PRECAST CONCRETE GIRDERS

[76] Inventor: Sun Ja Kim, 10-31, Byuksan village, #1, Chungun-dong, Chongno-gu, Seoul, Rep. of Korea

[21] Appl. No.: 831,522

[22] Filed: Apr. 1, 1997

[30] Foreign Application Priority Data

Apr. 8, 1996 [KR] Rep. of Korea ..... 1996/10881

[51] Int. Cl.[6] ..... E01D 21/00; E01D 19/08; E04C 3/10

[52] U.S. Cl. ..... 14/77.1; 14/74.5; 52/223.12

[58] Field of Search ..... 52/223.6, 223.7, 52/223.8, 223.9, 223.11, 223.12, 223.13; 264/228; 404/70; 14/73, 74.5, 77.1, 24

[56] References Cited

U.S. PATENT DOCUMENTS 4,245,923 1/1981 Rieve ..... 404/70
4,709,456 12/1987 Lyer ..... 14/74.5 X
5,313,749 5/1994 Conner ..... 52/223.12
5,425,152 6/1995 Teron ..... 14/24
5,655,243 8/1997 Kim ..... 14/74.5

OTHER PUBLICATIONS

"Design of Prestressed Concrete Structure" second edition, T. Y. Lin, pp. 6308–313.

*Primary Examiner*—Tamara L. Graysay
*Assistant Examiner*—Sumil Singh
*Attorney, Agent, or Firm*—Stevens, Davis, Miller & Mosher, L.L.P.

[57] ABSTRACT

A method for connecting precast concrete girders by tensioning temporary tendons lower than the neutral axes of girders, supporting the girders at the both ends, placing concrete into the gap, tensioning the tendons which connect adjacent girders while releasing the temporary tendons in order to reduce the bending moment at the midspan of girders.

2 Claims, 2 Drawing Sheets

FIG. 5
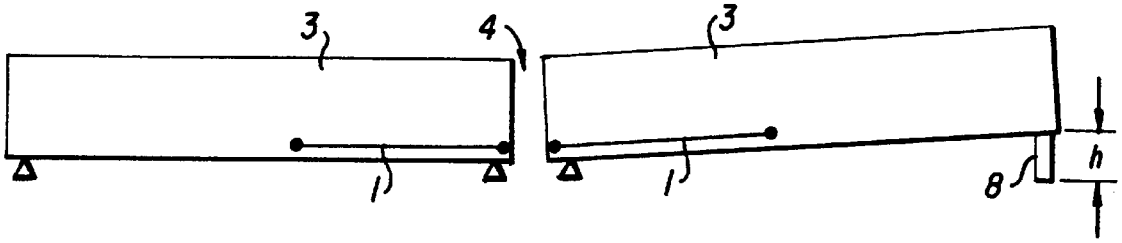
FIG. 6
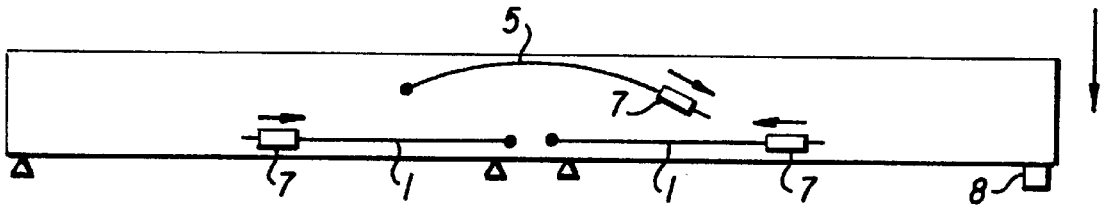
FIG. 7A
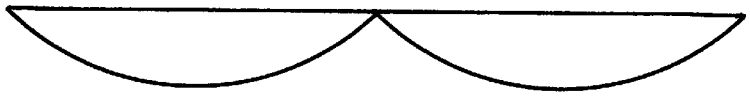
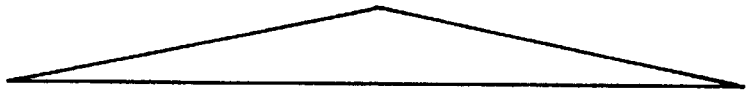
FIG. 7B
FIG. 7C
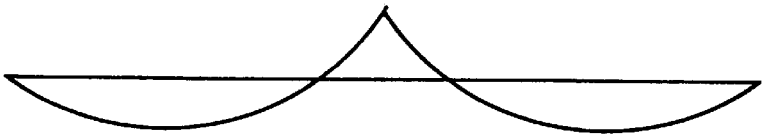

METHOD FOR CONNECTING PRECAST CONCRETE GIRDERS

BACKGROUND OF THE INVENTION

1. Field of the Invention

The present invention relates to a method for connecting precast concrete girders in construction work, for example, bridge superstructure.

2. Description of the Prior Art

In U.S. Pat. No. 5,655,243 entitled "Method for connecting precasting concrete beams, this inventor suggested a method for connecting precast concrete beams, in which precast concrete beams are supported at both ends, uplifting forces are applied to the central points of the beams, concrete is placed into the gaps between the ends of the adjacent beams, tendons which connect the adjacent beams are positioned and then tensioned and anchored with reducing the uplifting forces, so that the bending moment caused by the self-weight of the beams is reduced and as a result the size of beam section is reduced.

In order to apply the uplifting forces to the central points of beams, temporary piers or lifting equipments should be used, and when the clearance under the beam is large, it is difficult to apply the uplifting forces. In this respect, there is a need of an improved method for connecting precast concrete beams or girders in which temporary pier or lifting equipment is not needed.

SUMMARY OF THE INVENTION

It is an object of the present invention to provide a method for connecting precast concrete girders in which the bending moment caused by the self-weight of girders is reduced without applying uplifting forces to the central points of girders.

In the embodiment of the present invention, the object is accomplished by using temporary tendons. The temporary tendons are positioned lower than the neutral axes of the girders, and then tensioned and anchored. Then, the girders are supported at both ends, the tendons which connect the adjacent girders are positioned, concrete is placed into the gaps between the ends of the adjacent girders.

As the tendons which connect the girders are tensioned and anchored, the temporary tendons are released, so that the reaction of supports which are far from the connected ends is reduced and as a result the bending moment at the midspan of the girders is reduced. This is the same effect as that of reducing the uplift forces at the central points of beams in the prior invention.

BRIEF DESCRIPTION OF THE DRAWINGS

The preferred embodiments are described with reference to the drawings wherein:

FIG. 5 is a schematic view showing the second step of embodiment 2.

FIG. 6 is a schematic view showing the fourth step of embodiment 2.

FIGS. 7A to 7C show bending moment diagrams.

DETAILED DESCRIPTION OF THE PREFERRED EMBODIMENTS

These embodiments are merely intended to illustrate the present invention in detail and should not be considered to be a limitation on the scope of the invention.

Embodiment 1 a) First Step

Figure 1:
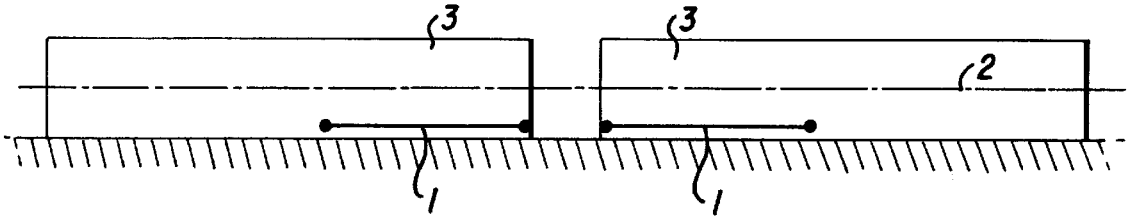
FIG. 1 is a schematic view showing the first step of embodiment 1.

Temporary tendons 1 are positioned lower than neutral axes 2 of precast concrete girders 3 which are placed on the casting yard as shown in FIG. 1. In order to maximize the secondary bending moment caused by releasing the temporary tendons in the fourth step of this embodiment, temporary tendons are positioned from the first connected ends toward the direction of the second ends of girders to some needed lengths. Then, the temporary tendons are tensioned and anchored to the anchor blocks which are equipped to the webs or lower flanges of the precast concrete girders. By tensioning the temporary tendons, the girders are bent upwards.

b) Second Step

Figure 2:
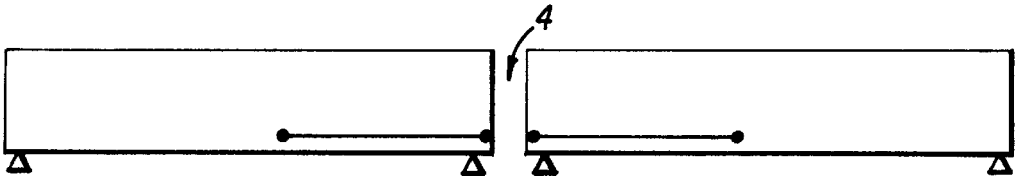
FIG. 2 is a schematic view showing the second step of embodiment 1.

The precast concrete girders 3 are supported at both the first and second ends with a gap 4 between the first ends of adjacent girders as shown in FIG. 2. The bending moment caused by the self-weight of supported girders at this stage is shown in FIG. 7A.

c) Third Step

Figure 3:
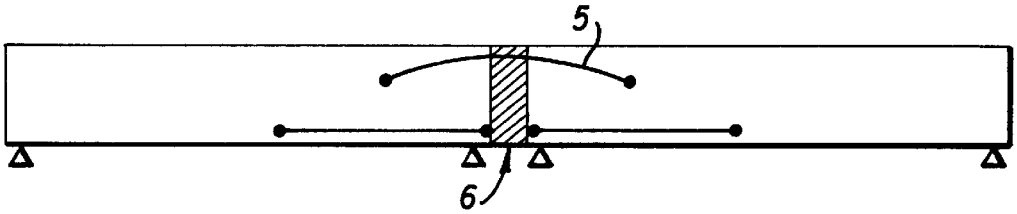
FIG. 3 is a schematic view showing the third step of embodiment 1.

The tendons 5 which connect the adjacent girders 3 are positioned as shown in FIG. 3. Generally, the tendons 5 are positioned higher than the neutral axes 2 of the girders for the structural needs. Then, concrete 6 is placed into the gap 4 between the first ends of adjacent girders as shown in FIG. 3 and hardened.

d) Fourth Step

Figure 4:
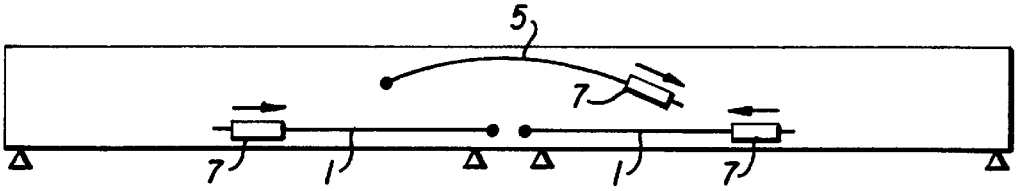
FIG. 4 is a schematic view showing the fourth step of embodiment 1.

The tendons 5 which connect the adjacent girders are tensioned and anchored to the anchor blocks which are equipped to the webs of the girders as shown in FIG. 4. At the same time, the temporary tendons 1 are released as shown in FIG. 4. The tensioning and releasing works are performed simultaneously at substantially the same rate to avoid cracks at the contact point between the end of girder and the placed concrete 6. Prestressing jacks 7 are used for tensioning and releasing work.

When the tendons 5 are tensioned and the temporary tendons 1 are released, the second ends which are far from the first connected ends tend to rise upward, and the reaction of supports under the second ends is reduced, and as a result a secondary bending moment takes place to the girders as shown in FIG. 7B. This secondary bending moment is overlapped on the bending moment caused by the self-weight of supported girders in the second step of this embodiment, which is shown in FIG. 7A. The resultant is the bending moment shown in FIG. 7C, whose value at the midspan is smaller than the bending moment in FIG. 7A. The bending moment at the midspan is reduced through the four steps of this embodiment, and as a result the size of girder section can be reduced.

Embodiment 2 a) First Step

This step is the same as the first step of embodiment 1.

b) Second Step

The precast concrete girders 3 are supported at both the first and second ends with a gap 4 between the first ends of adjacent girders. One of the second ends which is far from the ends to be connected is supported higher than the final construction level to some height h as shown in FIG. 5. The bending moment caused by the self-weight of supported girders at this stage is shown in FIG. 7A.

c) Third Step

This step is the same as the third step of embodiment 1.

d) Fourth Step

The tendons 5 which connect the adjacent girders are tensioned and anchored to the anchor blocks which are equipped to the webs of girders. At the same time, the temporary tendons 1 are released, and the higherly supported second end is lowered to the final construction level as shown in FIG. 6. The tensioning, releasing and lowering works are performed simultaneously at substantially the same rate to avoid cracks at the contact point between the end of girder and the placed concrete 6.

Prestressing jacks 7 are used for tensioning and releasing work and hydraulic or mechanical jack 8 is used for lowering work. When the tendons 5 are tensioned and the temporary tendons 1 are released with lowering the higherly supported end, the reaction of the supports under the ends which are far from the connected ends of girders is reduced, and as a result a secondary bending moment takes place to the girders as shown in FIG. 7B.

Lowering of the higherly supported end also contributes to make secondary bending moment as the tensioning of the tendons 5 and releasing of the temporary tendons 1. This secondary bending moment is overlapped on the bending moment caused by the self-weight of supported girders in the second step of this embodiment, which is shown in FIG. 7A. The resultant is the bending moment shown in FIG. 7C, whose value at the midspan is smaller than the bending moment in FIG. 7A. The bending moment at the midspan is reduced through the four steps of this embodiment, and as a result the size of girder section can be reduced.

While only certain embodiments of the invention have been specifically described herein, it will be apparent that numerous modifications may be made thereto without departing from the spirit and scope of the invention.

What is claimed is:

1. A method for connecting precast concrete girders each girder having a first end and a second end, the first end of one of the girders to be connected to the first end of another of the girders, comprising the steps of:

(a) positioning temporary tendons lower than the neutral axes of the precast concrete girders from the first ends to be connected to the direction of the second ends of the respective girders to some needed lengths and then tensioning and anchoring the temporary tendons to anchor blocks equipped to the precast concrete girders, (b) supporting the precast concrete girders at the first and second ends with a gap between the first ends of adjacent girders, (c) positioning tendons which connect adjacent precast concrete girders and placing concrete into the gap between the first ends of the adjacent girders, (d) tensioning the tendons which connect the adjacent precast concrete girders and anchoring the tendons to the anchor blocks equipped to the girders while releasing the temporary tendons of the precast concrete girders.

2. The method for connecting precast concrete girders according to claim 1, wherein the second end of the girder is supported higher than a final construction level during said step (b) of claim 1, and then lowered to the final construction level during said step (d) of claim 1.

* * * * *